US006589034B2

(12) United States Patent
Vorwerk et al.

(10) Patent No.: US 6,589,034 B2
(45) Date of Patent: Jul. 8, 2003

(54) BACKFLOW ORIFICE FOR CONTROLLING NOISE GENERATED BY A ROTARY COMPRESSOR

(75) Inventors: Christoph Vorwerk, Cologne (DE); Volker Heumann, Weilerswist (DE)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/064,821

(22) Filed: Aug. 21, 2002

(65) Prior Publication Data

US 2003/0039568 A1 Feb. 27, 2003

(30) Foreign Application Priority Data

Aug. 21, 2001 (EP) ..... 01120052

(51) Int. Cl.[7] ..... F03C 2/00
(52) U.S. Cl. ..... 418/15; 418/206.4; 418/180
(58) Field of Search ..... 418/15, 206.4, 418/201.1, 180

(56) References Cited

U.S. PATENT DOCUMENTS 4,564,345 A * 1/1986 Mueller ..... 418/206.5
4,609,335 A * 9/1986 Uthoff, Jr. ..... 418/206.4
4,768,934 A * 9/1988 Soeters, Jr. ..... 418/15

FOREIGN PATENT DOCUMENTS

EP 0174171 3/1990

* cited by examiner

*Primary Examiner*—Thomas Denion
*Assistant Examiner*—Theresa Trieu
(74) *Attorney, Agent, or Firm*—Diana D. Brehob

(57) ABSTRACT

The invention relates to the design of backflow orifices for a rotary compressor serving as a compressor for an engine. One example of such a rotary compressor is a roots blower. The fluid conveyed by two oppositely rotating rotors from an inlet to an outlet of the compressor flows back partially via the backflow orifices. The edges of the backflow orifices are at a varying height from an inner surface contour of the pump casing. The height variation contributes to a reduction in the noise generated by the compressor.

9 Claims, 2 Drawing Sheets

BACKFLOW ORIFICE FOR CONTROLLING NOISE GENERATED BY A ROTARY COMPRESSOR

BACKGROUND OF INVENTION

1. Field of the Invention

The invention relates to rotary compressors, or roots-type blowers, of the backflow type, and more particularly, to reducing noise associated with roots blowers employed as superchargers for internal combustion engines.

2. Background of the Invention

A roots blower is known in the prior art, for example EP 0 174 171 B1. Rotary compressors of this type are used, for example, in motor vehicles to convey compressed air to the internal combustion engine. The air is enclosed in a transfer volume on the inlet side of the pump between vanes of the axial rotors and the pump casing and is conveyed to the outlet side of the pump. During the conveyance, no volume change of the transfer volume takes place, and thus, no pressure rise. The outlet sides is at a higher pressure, so that when the transfer volume is opened toward the outlet side, a backflow of the volume of fluid in the transfer volume occurs, and hence the gases are pressurized.

In the prior art, the nature and quantity of the backflow in roots blowers is influenced by backflow orifices. These orifices are designed to reduce noise and vibration that are known to occur in such blowers due to the unsteady nature of the pressurization process. To achieve the desired result, various positions, lengths, and widths of the usually slot-shaped backflow orifices are proposed in the prior art. One such example is shown in EP 0 174 171 B1 in which an approximately V-shaped backflow orifice is disclosed. In the prior art, the opening of the backflow orifices are located parallel to the blower's casing.

The inventors of the present invention have recognized that the noise reduction measures, as presented in the prior art, do not satisfactorily control supercharger noise. Measurements of the dynamic pressure at the outlet of roots blowers coupled to internal combustion engines indicate resonances at various compressor speeds. These resonances arise at the basic orders of the roots blower, e.g., $3^{rd}$, $6^{th}$, $9^{th}$, $12^{th}$, and harmonic orders, excite a specific characteristic mode within the blower due to acoustic coupling of the transfer volume of the compressor to the under pressure inlet system of the engine via the backflow orifices.

SUMMARY OF INVENTION

Drawbacks of the prior art are overcome by a rotary compressor, preferably a roots blower, having an inlet, an outlet, two axially parallel rotors, engaging one into the other, for conveying a transfer volume, enclosed between vanes of the rotors and the pump casing, from the inlet to the outlet, including a backflow orifice arrangement attached to the pump casing in the region of the outlet for exchanging fluid with the transfer volume. An edge of the backflow orifice arrangement is at a varying height from an inner surface of the pump casing. Preferably, the height of the backflow orifice varies continuously, an example of which is a linear variation in height. In one embodiment, the height of the edge is at a minimum closer to the outlet and at a maximum at a farther from the outlet.

In contrast to known roots blowers, the present invention discloses that the outlet of the backflow orifice does not lie in a surface parallel to the blower's casing. Instead, it projects, at least partially, beyond such the blower's casing. Such a variation in the height of the edge of the backflow orifice has a damping influence on the noise generated by the compressor. The exact geometry of the outlet can be optimized by testing.

According to the invention, the roots blower has at least one backflow orifice, the edge of which is at a varying distance or height from the inner casing contour. The variation in the height of the edge occurs continuously, that is, without jumps or discontinuities. For example, the height of the edge from the casing may increase linearly or in a ramp-like manner from a minimum distance to a maximum distance.

An advantage of the present invention is that a roots blower, according to the present invention, has lower operating noise. This diminution of noise occurs at resonant orders of the blower. Furthermore, the shape of the edges of the backflow orifice has been shown to reduce the sound level over the 8500 to 12000 rpm speed range.

Other advantages, as well as objects and features of the present invention, will become apparent to the reader of this specification.

BRIEF DESCRIPTION OF DRAWINGS

The invention is explained in more detail below, by way of example, with reference to the figures in which.

DETAILED DESCRIPTION

Figure 1:
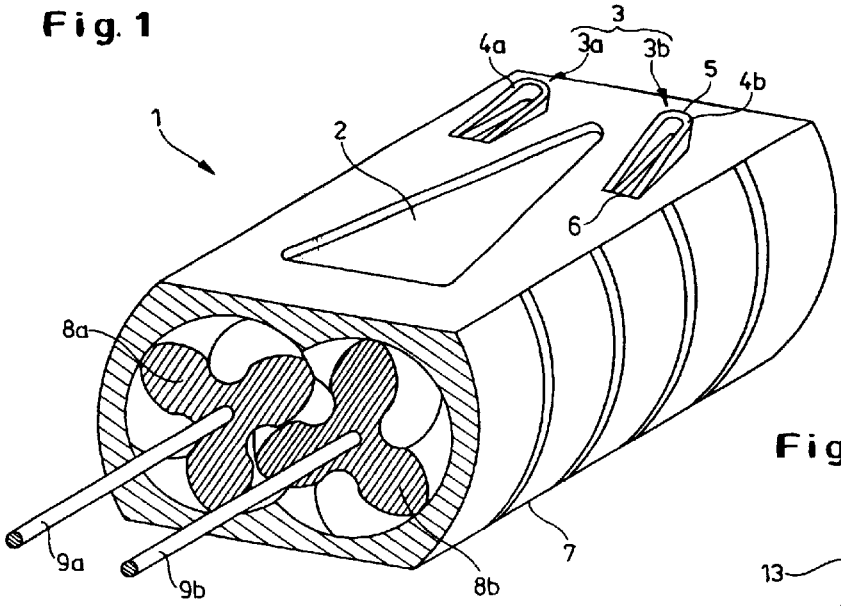
FIG. 1 is a perspective view of the roots blower according to an aspect of the invention.

A roots blower 1 is shown in cross section in FIG. 1. This pump may be used on an engine of an internal combustion engine. Blower 1 consists essentially of two parallel axial rotors, 8*a* and 8*b*, which, in the example illustrated, each have three vanes running helically along axes 9*a* and 9*b* of rotors 8*a* and 8*b*. The invention is also suitable for axially parallel vanes and for blowers with two or more vanes. Rotors 8*a* and 8*b* are in contact such that, during rotation in opposite directions, they enclose a transfer volume between their vanes and the casing. The transfer volume is conveyed from the underside of blower 1 to the top side. Rotors 8*a* and 8*b* are located in cylindrical tubes which partially overlap one another and are formed by the walls of blower 1.

An inlet orifice 7 (concealed in FIG. 1) is located on the underside or rear side of blower 1. An associated triangular outlet orifice 2 is located on the top side. Air enclosed in a transfer volume between the rotating rotors 8*a* and 8*b* on the side of the inlet 7 is transported with a constant volume to outlet 2 and is discharged. Since the outlet side is normally under a higher pressure, when the transfer volume opens up to the outlet side, a backflow of the fluid occurs until the pressure is equalized. This backflow is a source of the noise of blower 1. To influence the backflow noise, it is known to provide a backflow orifice arrangement 3 next to outlet 2 which consists of slot-shaped or other shaped backflow orifices 3*a* and 3*b*.

In the prior art, only the length, width, and position of backflow orifices 3*a* and 3*b* have hitherto been varied. It is proposed, according to the present invention, to vary the height of the edges 4*a* and 4*b* of backflow orifices 3*a* and 3*b*.

Edges 4*a* and 4*b* do not lie in the plane of the surface of the pump casing or in a plane parallel to the pump casing.

Thus, in the embodiment illustrated in FIG. 1, two backflow orifices 3*a* and 3*b* are slot-shaped, the longitudinal extent of the slots being approximately parallel to the sealing inclination of rotor vanes 8*a* and 8*b*. Edges 4*a* and 4*b* of orifices 3*a* and 3*b* have a ramplike run, the minimum height of edges 4*a* and 4*b* being at end 6 which faces outlet 2 and the greatest height of the edge at end 5 which is farthest away from outlet 2.

It was shown that the height variation of edge 4*a* and 4*b* of orifices 3*a* and 3*b* decreases the noise level of pump 1. The occurrence of the noises at pump 1 may be tentatively explained by the fact that the transfer volume between rotors 8*a* and 8*b* and the pump casing and the narrowing of backflow orifices 3*a* and 3*b* act as a Helmholtz resonator. The resonant frequency of this resonator can be calculated (cf. William C. Elmore, Mark A. Heald: "Physics of Waves," Dover Publications, New York, ISBN 0-486-64926-1, p. 148). In the selected example, the frequency is about 650 Hz for a single rotor and the associated backflow orifice. Since the complete blower 1 consists of two rotors, 8*a* and 8*b*, engaging one into the other, each with its own backflow orifice, 4*a* and 4*b*, and the two resonators thereby formed are excited in antiphase, the noise frequency is doubled. Thus, for blower 1, the frequency is about 1300 Hz.

Figure 2:
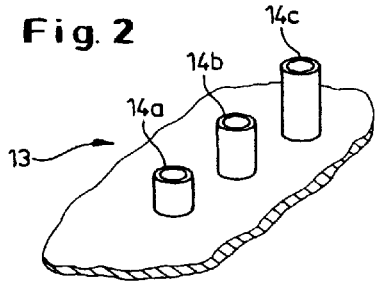
FIG. 2 is a perspective view of the backflow orifices according to an aspect of the invention.

As mentioned, the acoustical noise can be reduced by the ramplike run of edges 4*a* and 4*b* of the orifices, as illustrated in FIG. 1. An alternative embodiment of a backflow orifice arrangement 13 is illustrated in FIG. 2. Instead of the slot-shaped orifices with a ramplike edge, backflow arrangement 13 is formed by one or more orifices each having a chimney-like attachment with edges 14*a*, 14*b*, and 14*c*.

Figure 3:
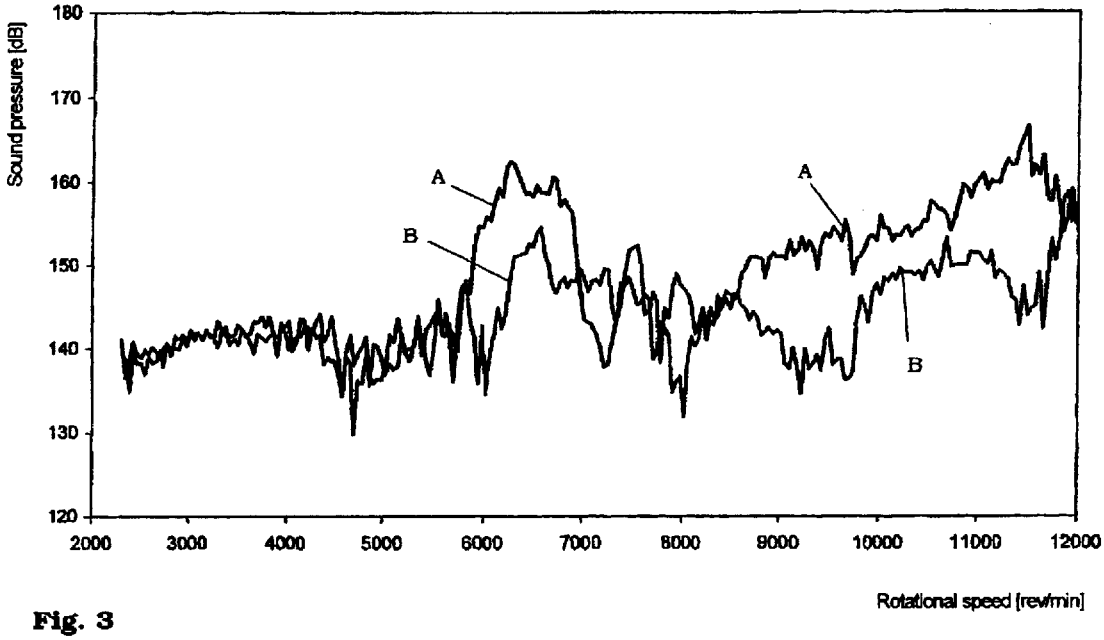
FIG. 3 is a graph of measured sound pressure as a function of pump rotational speed for a roots blower according to the present invention and for the prior art.

FIG. 3 shows the effect of the height variation of the edge, according to the present invention, on the noise. Sound pressure is plotted in dB on the ordinate and rotational speed of rotors 8*a* and 8*b* of blow 1 is plotted in rpm on the abscissa. Curve A shows the sound pressure that occurs in a conventional blower 1 without a height variation of the edge of the backflow orifices, i.e., the prior art. Curve B shows the sound pressure for blower 1 according to the present invention. At the resonant rotational speed of 6500 rpm at the $12^{th}$ order of blower 1, the pressure fluctuation at the outlet is significantly reduced. Blower 1 exhibits lower noise within the 8500–12000 rpm speed range also.

The height variation of the edge of the backflow orifices at the roots blower inlet constitutes a design parameter which can be adjusted to optimize acoustic behavior.

While several examples for carrying out the invention have been described, those familiar with the art to which this invention relates will recognize alternative designs and embodiments for practicing the invention. Thus, the above-described embodiments are intended to be illustrative of the invention, which may be modified within the scope of the following claims.

What is claimed is:

1. A rotary compressor having an inlet, an outlet, two axially parallel rotors, engaging one into the other, for conveying a transfer volume, enclosed between vanes of the rotors and the pump casing, from the inlet to the outlet, comprising:

a backflow orifice arrangement attached to the pump casing in the region of the outlet for exchanging fluid with the transfer volume wherein an edge of said backflow orifice arrangement is at a varying height from an inner surface of the pump casing.

2. The compressor of claim 1 wherein the compressor is a roots blower.

3. The compressor of claim 1 wherein a height of said edge of said backflow orifice varies continuously.

4. The compressor of claim 1 wherein said edges are at a varying distance from the plane in which the axes of the rotors lie.

5. The compressor of claim 4 wherein the compressor is a roots blower.

6. The compressor of claim 1 wherein said varying height of said edge is at a minimum height at a first side closer to the outlet and said edge is at a maximum height at a second side farther from the outlet.

7. The compressor of claim 1 wherein said variation in height is linear.

8. The compressor of claim 1 wherein said backflow orifice arrangement further comprises a multiplicity of backflow orifices wherein said backflow orifices are of differing heights.

9. The compressor of claim 1 wherein said multiplicity of backflow orifices has increased height as a distance from the outlet is increased.

* * * * *